US006227078B1

(12) United States Patent
Lemmo, Jr.

(10) Patent No.: US 6,227,078 B1
(45) Date of Patent: May 8, 2001

(54) ENGINE OIL FILTER SOCKET WRENCH WITH BUILT-IN SPILLAGE CUP

(76) Inventor: Vincent John Lemmo, Jr., 123 Adrienne Ave., Blackwood, NJ (US) 08012

( * ) Notice: Subject to any disclaimer, the term of this patent is extended or adjusted under 35 U.S.C. 154(b) by 0 days.

(21) Appl. No.: 09/515,426

(22) Filed: Feb. 29, 2000

(51) Int. Cl.[7] ..... B25B 13/06

(52) U.S. Cl. ..... 81/121.1; 81/3.09; 81/3.4; 81/120; 7/100

(58) Field of Search ..... 81/3.09, 3.4, 120, 81/121.1, 124.6, 124.7, 180.1; 7/100

(56) References Cited

U.S. PATENT DOCUMENTS

| | | | | |
|---|---|---|---|---|
| D. 309,974 | | 8/1990 | Tannous . | |
| 3,385,141 | * | 5/1968 | Norman | 81/120 |
| 4,266,452 | | 5/1981 | Crist . | |
| 4,376,703 | | 3/1983 | Krauss . | |
| 4,451,368 | | 5/1984 | Pandelena et al. . | |
| 4,763,620 | | 8/1988 | Zastocki . | |
| 4,867,017 | * | 9/1989 | Holman | 81/121.1 |
| 5,271,299 | | 12/1993 | Wadsworth . | |
| 5,353,666 | | 10/1994 | Rogers . | |
| 5,366,084 | | 11/1994 | Post . | |
| 5,386,748 | | 2/1995 | Kilgore . | |
| 5,438,893 | | 8/1995 | Rogers . | |
| 5,440,957 | | 8/1995 | Rogers . | |
| 5,469,935 | | 11/1995 | Hewuse . | |
| 5,606,897 | | 3/1997 | Quinn . | |
| 5,852,961 | * | 12/1998 | Kotowski | 81/180.1 |

* cited by examiner

*Primary Examiner*—James G. Smith

(57) ABSTRACT

An engine oil filter socket wrench with built-in spillage cup contains the oil that normally spills out when an oil filter is removed from an engine. The device consists of a smaller first cylinder for gripping an oil filter base and a larger second cylinder built concentrically around and above the smaller cylinder and forming a cup shaped reservoir capable of containing oil spillage. Protuberances projecting radially inward from the inside surface of the larger cylinder terminate in loose contact at the filter surface to provide alignment of the device about the filter and to provide a second means to grip the filter. The larger cylinder can be constricted of flexible material capable of being squeezed by hand to create a frictional grip on the oil filter body for the purpose of initially loosening the filter from its mount.

36 Claims, 7 Drawing Sheets

ENGINE OIL FILTER SOCKET WRENCH WITH BUILT-IN SPILLAGE CUP

BACKGROUND OF THE INVENTION

1. Technical Field

This invention relates generally to automotive engine oil filters commonly known as replaceable "spin-on" oil filters and relates in particular to devices used to loosen and remove oil filters known as engine oil filter socket wrenches. The present invention is a type of engine oil filter socket wrench designed to contain oil spillage.

Technical field classification definition includes class 81 wrench, screwdriver, or driver therefor, subclass 119 rigid jaws, subclass 121.1 enclosed (e.g. socket), and 124.6 having axial opening for removable handle.

2. Description of Prior Art

The Quinn patent U.S. Pat. No. 5,606,897 provides a detailed description of a conventional oil filter socket wrench in combination with a packaging method. The Quinn device does not discuss or suggest oil spillage and such a structure could not inherently contain oil spillage given its through-hole design. The present invention does however rely on the Quinn patent to show a means of engaging an oil filter for purpose of loosening and removing the filter referred to as angled facets or segments. Quinn does not show an oil filter.

The design patent of Tannous Des. 309974 is relied on to show a detailed picture of a conventional oil filter and to show the angled facets or segments of the filter corresponding to the angled facets or segments of an oil filter socket wrench such as that shown in the Quinn device. The Tonnous patent does not suggest containing oil spillage and the device could not do so inherently.

The disclosure of this present invention illustrates a typical prior art oil filter socket wrench in prior art FIGS. 1, 2, and 2A. Prior art FIG. 1 details the oil spillage problem of the prior art. It is this oil spillage problem of the prior art that the present invention overcomes.

As shown in prior art FIG. 1, oil filter 5, a typical spin-on oil filter in common use, has threaded attachment hole 4 corresponding to engine block oil gallery fitting 1 with matching threads 2. Fitting 1 fastens oil filter 5 securely to an engine block without any oil spillage occurring. However, when oil filter 5 is loosened and removed from fitting 1, by use of prior art oil filter socket wrench 10, oil spillage 3 is initiated. Oil spillage 3 is in the form of residual oil droplets coming out of fitting 1 and also residual oil flowing out of filter 5 and onto and past prior art oil filter socket wrench 10. It is likely oil spillage 3 will spill onto a garage floor or onto the hand of a mechanic using prior art oil filter socket wrench 10 and create a hazard.

It is important to note that prior art oil filter socket wrench 10 was never intended to contain oil spillage 3 and does not have a structure that would inherently contain oil spillage 3. Evidence of the fact that prior art oil filter socket wrench 10 was never intended to contain oil spillage 3 is seen in prior art FIGS. 2 and 2A with square cutout through-hole 17. Square cutout through-hole 17 provides a means to attach a drive device such as a ratchet drive to the prior art oil filter socket wrench 10. Since the ratchet drive is intended to be placed into square cutout through-hole 17 readily by hand, square cutout through-hole must provide a loose fit and therefore could not inherently seal-in oil spillage 3. Also, since prior art oil filter socket wrench 10 has the shape of essentially a single cylinder, shown as first cylindrical member 12 in prior art FIG. 1, and fits snugly onto oil filter 5 in order to grip it properly, prior art oil filter socket wrench 10 would lack the volumetric capacity to contain oil spillage 3.

SUMMARY OF THE INVENTION

The main objective of the present invention is to overcome the oil spillage problem of the prior art by providing an inventive cup-shaped structure built concentrically around and above an existing prior art oil filter socket wrench. The inventive cup-shaped structure forms a larger second cylindrical member mounted atop a smaller first cylindrical member of the prior art. When an oil filter is loosened and removed using the present invention, any oil spillage coming out of the mounting fitting of the oil filter or from within the oil filter itself is neatly collected and held within the inventive larger second cylindrical member until it can be safely poured into a proper receptacle. In at least one embodiment, protuberances project radially inward from the inside surface of the larger cylinder and terminate in loose contact at the oil filter surface to provide alignment of the device about the filter. Additionally, the larger cylinder can be constructed of flexible material capable of being squeezed by hand to create a frictional grip between the protuberances and the oil filter body for the purpose of turning and loosening the oil filter from its mount.

A second objective of the present invention is to provide a new and useful oil filter socket wrench that can be readily made by hand at minimal cost and with common hand tools and materials. The present invention teaches how a prior art oil filter socket wrench is modified to become part of the new and useful present invention.

DETAILED DESCRIPTION OF THE INVENTION

The engine oil filter socket wrench 20 of the present invention is illustrated in FIGS. 3, 4, 4A, and 4B, where the same parts are indicated by the same numbers throughout the various figures. Common terms such as "top, bottom, upper, lower, and upright" refer to conventional positions as they are most often found in an automotive application.

It is important to note that the present invention is constructed by hand by modifying prior art socket wrench 10, illustrated in FIGS. 1 through 4B. Prior art socket wrench 10, in its entirety, becomes a component of the present invention. Prior art oil filter socket wrenches of the type used to construct the present invention are readily available in automotive parts stores.

Figure 3:
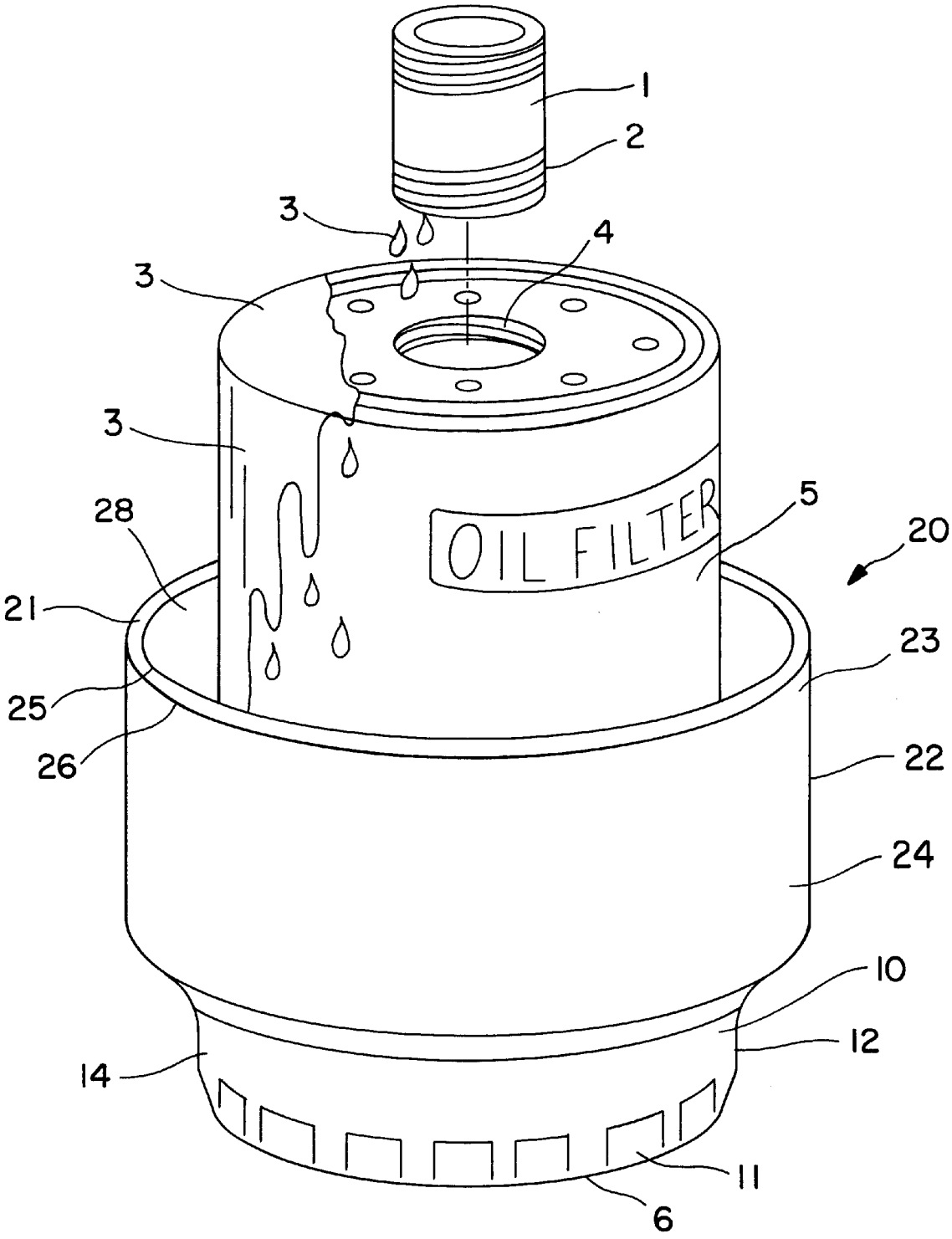
FIG. 3 is a perspective top view of the oil filter socket wrench of a preferred embodiment of the present invention.

A preferred embodiment of the present invention is illustrated in FIG. 3. Oil filter socket wrench 20 is shown generally in FIG. 3 with important features seen from the outside. Inventive larger second cylindrical member 22, with gap 28, upper portion 23 and lower portion 24 is shown affixed concentrically around and above smaller first cylindrical member 12 of prior art socket wrench 10. As seen in FIG. 4A, second cylindrical member 22 also includes inner surface 25 and outer surface 26. Second cylindrical member 22 is substantially cylindrical in shape.

Figure 1:
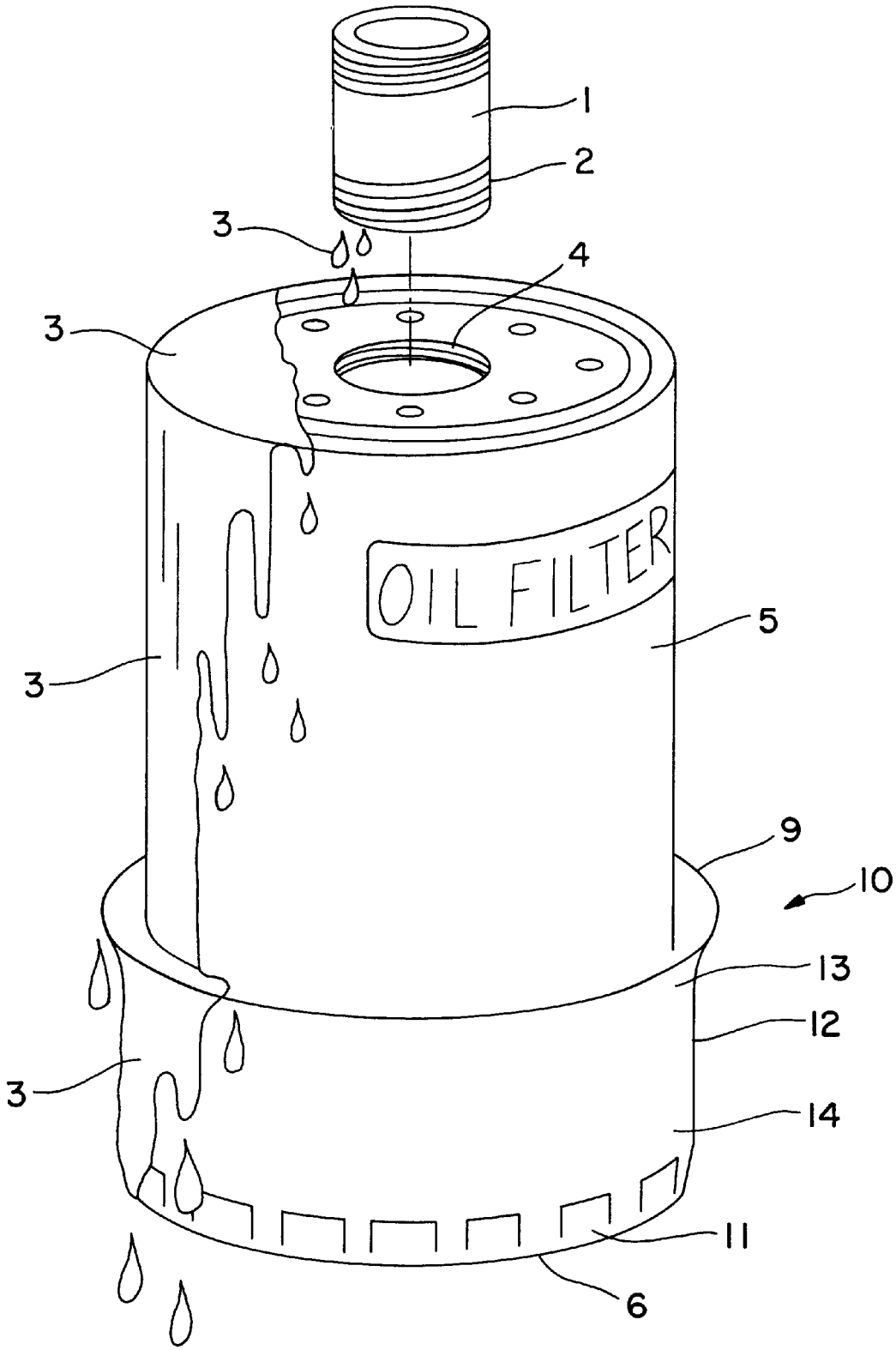
FIG. 1 PRIOR ART
FIG. 1 is a perspective top view of the prior art oil filter socket wrench.
Figure 2:
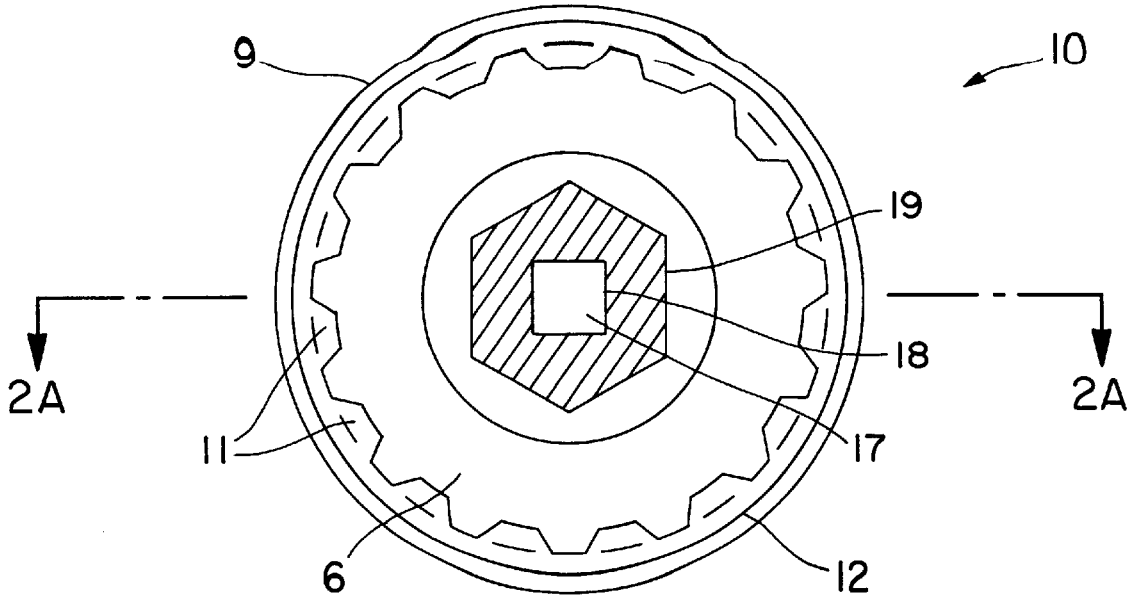
FIG. 2 PRIOR ART
FIG. 2 is a bottom view of the prior art oil filter socket wrench.
Figure 2A:
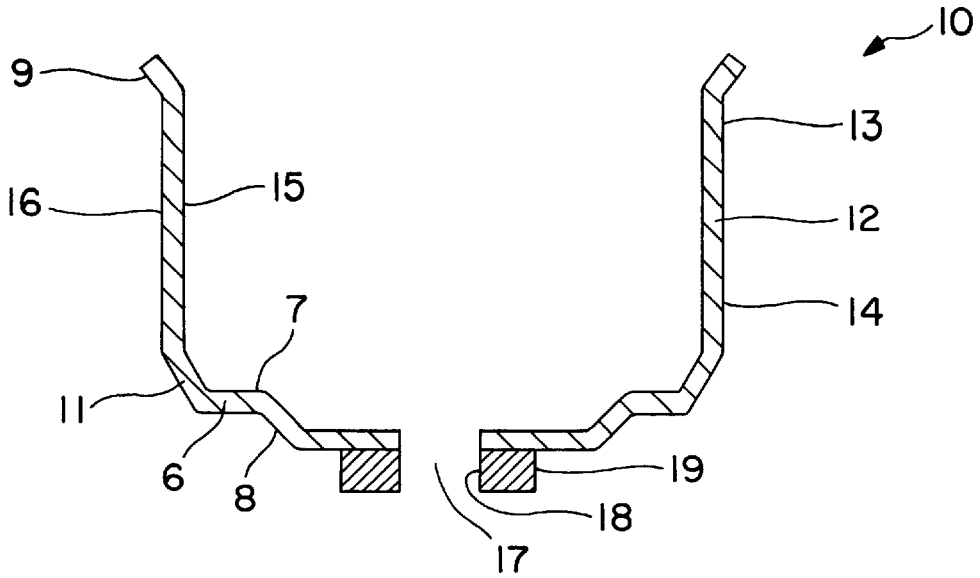
FIG. 2A PRIOR ART
FIG. 2A is a cross-sectional side view of the prior art oil filter socket wrench taken along line 2A—2A of FIG. 2.

Prior art socket wrench 10 is an integral component of the present invention and is seen in FIG. 3 with lower portion 14, circular base 6, and angled facets 11. Angled facets 11 provide a first means to engage an oil filter. To loosen oil filter 5, a drive tool such as a ratchet drive or conventional wrench is applied to either square cutout 18 of FIG. 2 or to hexagon 19 of FIGS. 2 and 2*a*. Torque applied to cutout 18 or hexagon 19 by a drive tool is transmitted to circular base 6 and angled facets 11 where corresponding angled facets of the oil filter are engaged and the filter loosened. Angled facets 11 also provide a first means to align oil filter socket wrench 20 around oil filter 5, of FIG. 3. Other important features of prior art oil filter socket wrench 10, shown in FIG. 2A, include upper surface 7 and lower surface 8 of circular base 6, upper portion 13, lower portion 14, inside surface 15, and outside surface 16 of first cylindrical member 12, and lip 9. First cylindrical member 12 is substantially cylindrical in shape. Prior art oil filter socket wrench 10 is also shown in FIGS. 3 through 4B, of the present invention.

Second cylindrical member 22 of FIG. 3, forms a side wall of inventive oil spillage cup 21 capable of containing oil spillage 3. Second cylindrical member 22 has a diameter that is substantially larger than the diameter of first cylindrical member 12. The diameter of second cylindrical member 22, together with its length, define a volume of gap 28 sufficient to contain oil spillage 3 associated with the loosening and removal of oil filter 5 while oil filter 5 is aligned into position within oil filter socket wrench 20. Oil spillage 3 typically has a volume of about 5 percent of the volume of oil filter 5.

Figure 4:
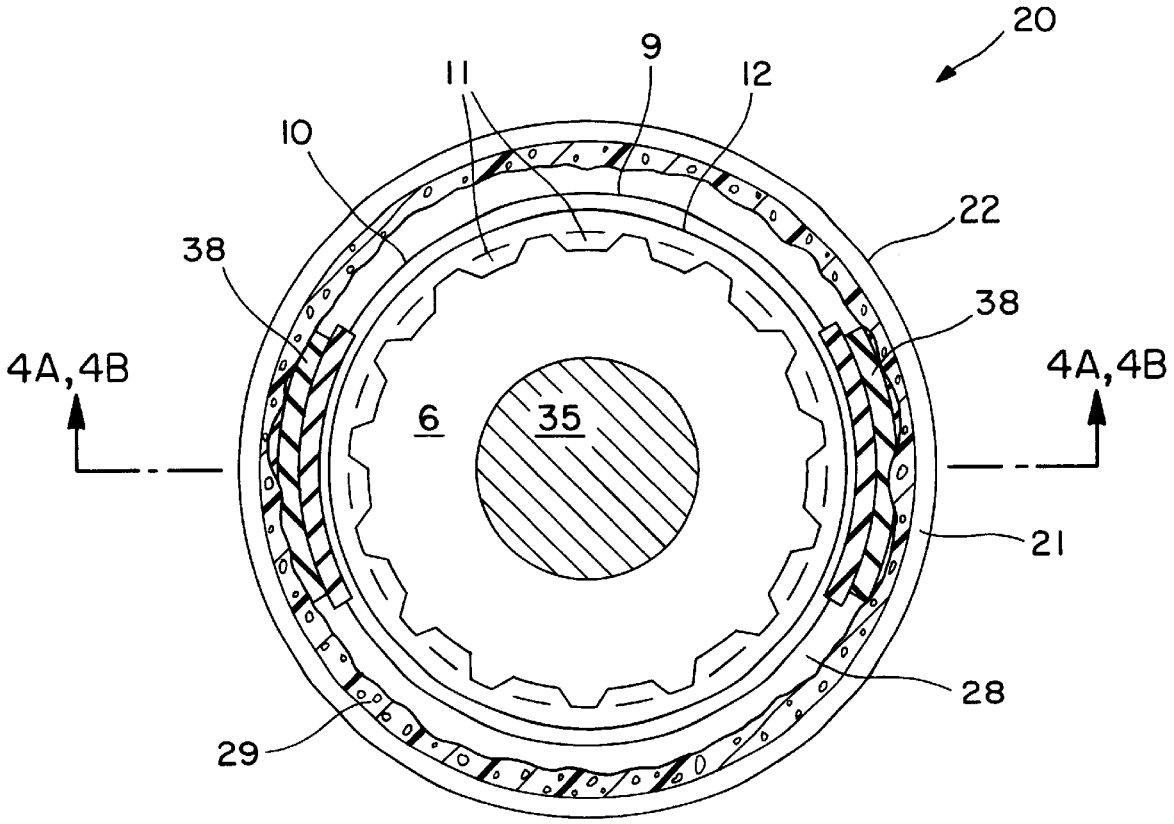
FIG. 4 is a top view of other preferred embodiments of the oil filter socket wrench of the present invention.
Figure 4A:
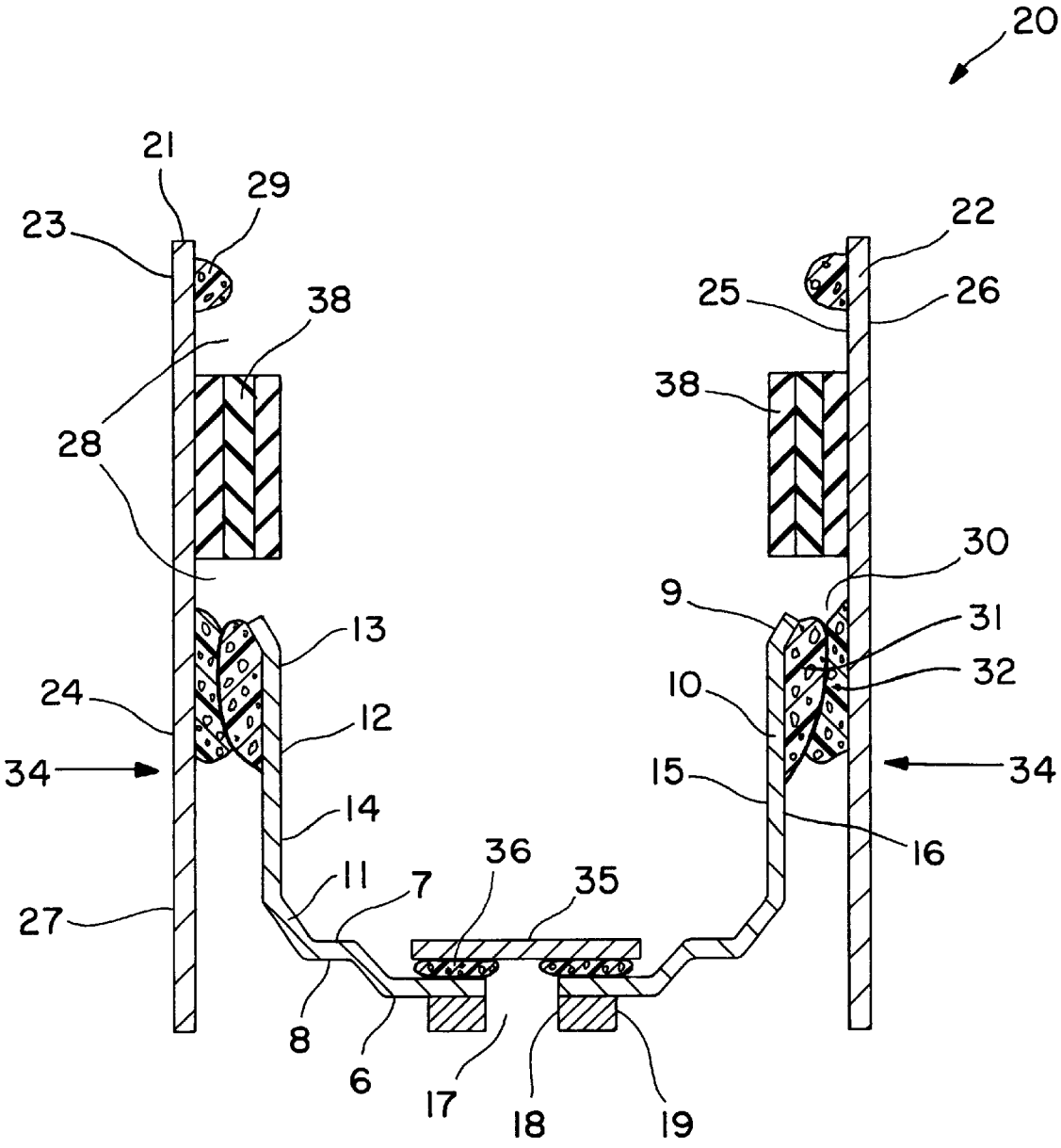
FIG. 4A is a cross-sectional side view of a second preferred embodiment of the oil filter socket wrench of the present invention taken along line 4A—4A of FIG. 4.
Figure 4B:
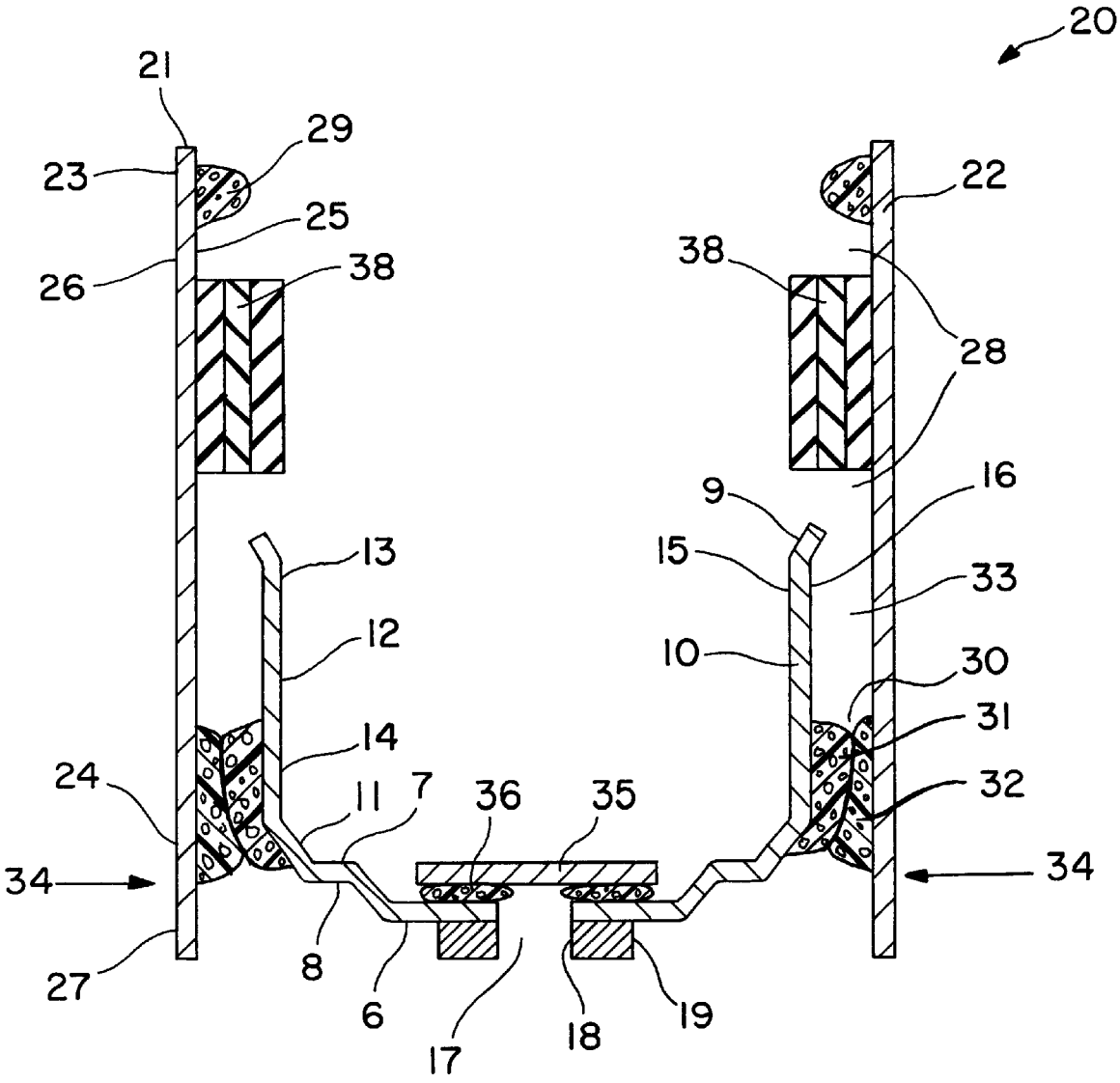
FIG. 4B is a cross-sectional side view of a third preferred embodiment of the oil filter socket wrench of the present invention taken along line 4B—4B of FIG. 4.

A second preferred embodiment of the present invention is shown in FIGS. 4 and 4A. The second preferred embodiment is distinguished from the embodiment shown in perspective view FIG. 3 in that the second cylindrical member 22, shown in FIG. 4 and 4A is fitted with a lip 29 and protuberances 38. Protuberances 38 are made of synthetic rubber and provide a second means to engage oil filter 5 for the purpose of loosening and removing oil filter 5. Lip 29 is made from a bead of silicone sealant and reduces oil spillage if socket wrench 20 is tilted while oil spillage is contained within cup 21. The embodiment of FIG. 4A also shows a construction detail present in second cylindrical member 22. Second cylindrical member 22 is shown with bottom portion 27 extending below lower portion 24. During construction, bottom portion 27 may be cut away at cut line 34 and leave lower portion 24 as the lowest portion of second cylindrical member 22. The resulting appearance would be as shown in perspective view FIG. 3.

Figure 5:
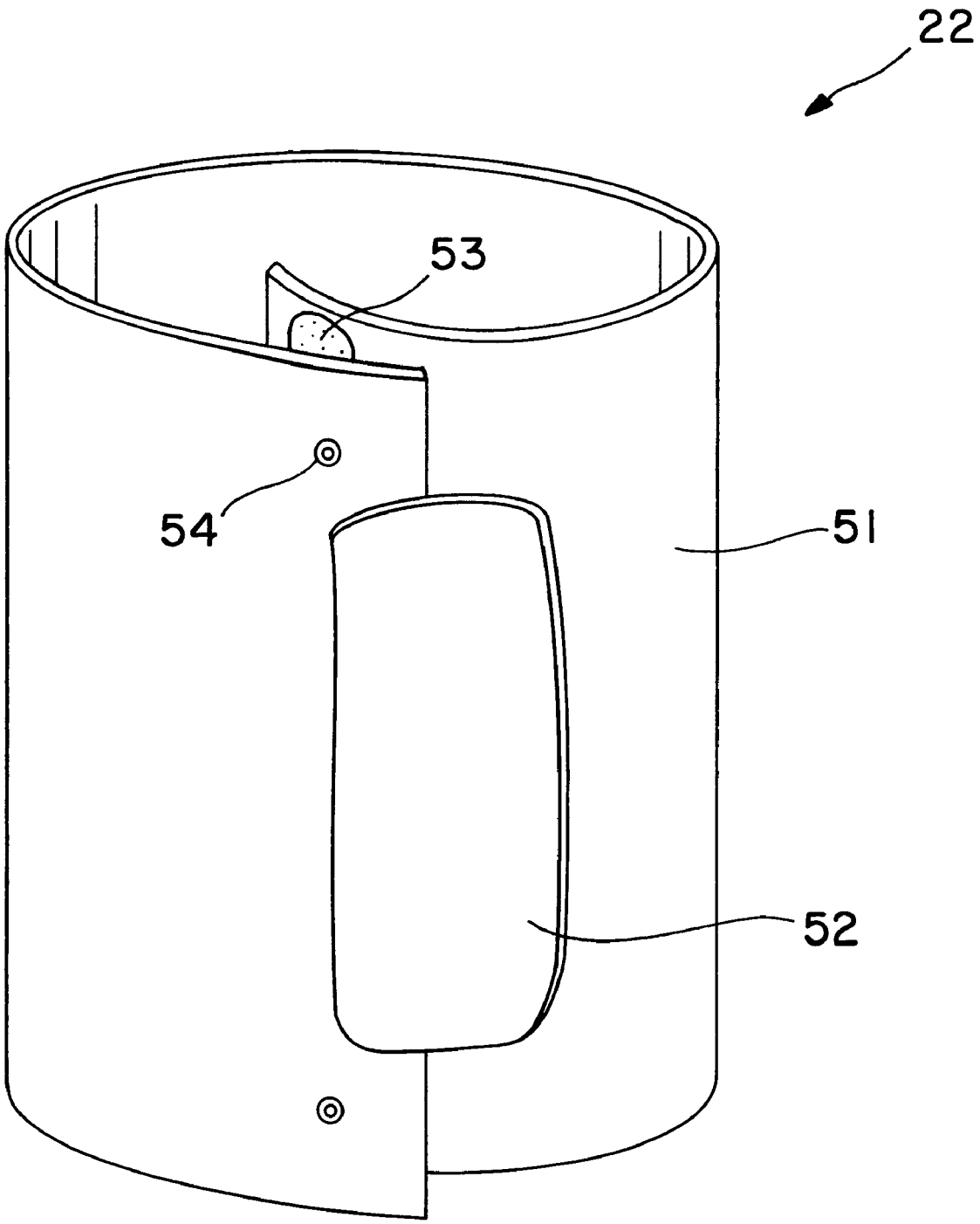
FIG. 5 is a top perspective view of a component of the oil filter socket wrench of the present invention.

The process of making and using the present invention will now be described. The first step is to construct second cylindrical member 22, shown generally in FIG. 5, from aluminum flashing 51. Aluminum flashing is used in roofing applications and is readily available in hardware stores. The aluminum flashing used for the present invention came with a thickness of 0.010 (ten thousandths) of an inch, a width of 8 inches, and a length of 10 feet curled into a roll with a diameter under 5 inches. Given its thinness and the fact that it comes curled into a roll, it lends itself to be easily curled into a cylinder by hand. From the original length of aluminum flashing, a pair of metal shears is used to cut a length equal to the desired circumference of second cylindrical member 22 plus approximately one additional inch to allow for an overlap joint. The desired circumference for second cylindrical member 22 should be approximately 20 percent larger than the circumference of first cylindrical member 12 of prior art socket wrench 10. After the aluminum flashing has been cut to length, the aluminum flashing is then cut to a width equal to the height of oil filter 5. With the length and width cut to size, aluminum flashing 51 is carefully curled into a roll by hand with an overlap of approximately one inch and temporarily fastened with duct tape 52 to keep it from unraveling. The curled roll of aluminum flashing 51 is then fasten permanently by applying silicone sealant bead 53. Silicone sealant is well known for its excellent adhesion. It is quite viscous when applied and then cures to a firm rubber-like state that is resistant to oil and extremes in temperature. Silicone sealant is readily available in hardware stores and comes in chalking tubes. Silicone sealant bead 53 is applied with a chalk gun to the inside of the overlap shown in FIG. 5. The overlap is then pressed together by hand. For added strength, pop-rivets 54 are added and their holes sealed with silicone sealant to prevent leaks.

It is important to note that the volume of inventive gap 28 of FIG. 3 is the result of the dimensions decided upon for the above mentioned length and width of aluminum flashing 51 used to form second cylindrical member 22. Increasing the length of aluminum flashing 51 would increase the circumference of second cylindrical member 22 and increase the volume of gap 28. The equation for the volume of a cylinder applies. A particular volume is a design choice determined by the amount of oil spillage of a particular application. A typical value for the volume of inventive gap 28 would be within, but not limited to, a range of approximately 5 to 30 percent of the volume of oil filter 5.

Second cylindrical member 22, formed by the construction of aluminum flashing 51, is now ready to be fastened to first cylindrical member 12.

Referring to FIG. 4A, silicone sealant is used to form intermediate member 30 from silicone bead 32 applied to inner surface 25 of second cylindrical member 22 and from silicone bead 31 applied to outer surface 16 of first cylindrical member 12. The process is as follows. Before silicone beads 31 or 32 are applied, second cylindrical member 22 is set upright on a level surface. Socket wrench 10 is then set upright inside second cylindrical member 22 on the same level surface. The location of inner surface 25 of second cylindrical member 22 opposite upper portion 13 of outer surface 16 of first cylindrical member 12 is noted and marked with a felt tip pen as the place to apply bead 32. Socket wrench 10 is then removed. Silicone sealant bead 32 is then applied in a circle around inner surface 25 of second cylindrical member 22 at the place noted above. It is important to note that bead 32 must be of sufficient size to extend more than halfway between inner surface 25 and outer surface 16 in order to meet and join bead 31 when applied. With bead 32 in place, second cylindrical member 22 is then set upright, as before, on a level surface. Next, bead 31 is applied in a circle around upper portion 13 of outer surface 16 of first cylindrical member 12. Like bead 32, bead 31 must be of sufficient size in order to meet and join bead 32.

First cylindrical member 12, with bead 31 in place, is then lowered upright and concentrically into second cylindrical member 22 and permitted to set on the same level surface supporting second cylindrical member 22. When first cylindrical member 12 is fully into position, bead 31 will adhere to bead 32 and form intermediate member 30. Intermediate member 30, when cured, will seal and secure second cylindrical member 22 to first cylindrical member 12 and form a single unit that is impermeable to oil spillage. Intermediate member 30 forms a third substantially cylindrical member that is positioned concentrically with, and joined to, the other two mentioned cylindrical members.

The next part to make is aluminum disk 35, shown in FIGS. 4 and 4A. Aluminum disk 35 is cut from excess aluminum flashing and secured into place over through-hole 17 with silicone sealant bead 36. Aluminum disk 35 seals through-hole 17 in circular member 6 to retain oil spillage, but does not block access to square cutout 18 by a drive tool. In effect, aluminum disk 35 becomes an integral part of circular base 6 and acts as a single unit with circular base 6.

After the silicone sealant of intermediate member 30 has cured, bottom portion 27 of second cylindrical member 22, shown in FIG. 4A, may be cut away at cut line 34 using metal shears and any sharp edges sanded. Second cylindrical member 22 now would then have lower portion 24 as a bottom. If desired for neatness, another bead of silicone sealant can be applied under intermediate member 30 and smoothed by finger to make a neat radius as shown in FIG. 3 above lower portion 14 of first cylindrical member 12. As a precautionary measure, before the device is used for the first time, it should tested for leaks by filling with water. In the unlikely event a leak is found, dry the device and add an additional bead of silicone sealant to the place of the leak and let cure.

It is important to note that first cylindrical member 12, second cylindrical member 22, intermediate member 30, and aluminum disk 35 within circular base 6, have been combined as a single unit as discussed above to form a unified integral cup that is impermeable to oil spillage and is capable of containing oil spillage associated with the loosening and removal of an oil filter.

The construction of protuberances 38, shown in FIGS. 4 and 4A, involves a buildup of synthetic rubber squares cut from a bicycle tire inner tube. A first square of the synthetic rubber has a side length equal to approximately ⅛ of the circumference of second cylindrical member 22 and is glued to upper portion 23 of inner surface 25 of second cylindrical member 22 just below lip 29 using contact cement glue. A second square of the synthetic rubber of the same size is glued to the same inner surface 25 but at 180 degrees around second cylindrical member 22 diametrically opposed to the first square. Additional squares of the synthetic rubber are then glued to the first two squares to make layers extending radially inward from inner surface 25 to oil filter 5. Final squares of the layers should just reach the surface of oil filter 5 in loose contact. The number of squares comprising the layers depends on the diameter of second cylindrical member 22. Also, it is anticipated that 3 layers can be position 120 degrees apart or 4 layers positioned 90 degrees apart, etc. Also, the shape and size of the protuberances are design choices and can be varied.

Protuberances 38 were first intended as a second means to align oil filter socket wrench 20 about oil filter 5. But, an unexpected result of the present invention arose. It was found that second cylindrical member 22, although rigid enough to provide a cup-shaped member, was flexible enough to be deformed by squeezing by hand. When second cylindrical member 22 was deformed by squeezing by hand, a frictional grip was created between protuberances 38 and oil filter 5. It become apparent that protuberances 38 could provide a second means to engage oil filter 5 for the purpose of loosening and removing oil filter 5.

If it is intended to use second cylindrical member 22 as a flexible member, an additional initial volume of cup 21 should be considered since squeezing second cylindrical member 22 will reduce volume.

If it is desired to have a rigid second cylindrical member 22, a heavier gauge aluminum sheet or stronger material, such as steel, can be used.

Socket wrench 10 is a device made from a stamping of steel and is substantially rigid and is capable of withstanding the stress of loosening and removing an oil filter without deformation. Prior art first cylindrical member 12 has a length of 1½ (one and one-half) inches, an inside diameter of 3 (three) inches, and a steel thickness of 0.047 (47 thousandths) of an inch. The dimension of a typical oil filter 5 is about 5 inches in length and about 3 inches in diameter to yield a volume of about 35 cubic inches.

Lip 29 is shown in FIG. 4A. Lip 29 is constructed from a single bead of silicone sealant placed at upper portion 23 of inner surface 25 of second cylindrical member 22. Lip 29 helps reduce spillage in the event that oil filter socket wrench 20 is tilted when removing oil filter 5. The dimensions of lip 29 is not crucial and is a design choice.

A third preferred embodiment of the present invention is shown in cross-sectional side view FIG. 4B. The embodiment of FIG. 4B differs from the embodiment of FIG. 4A in that beads 31 and 32 are placed at lower portion 14 of first cylindrical member 12 and create void 33 shown in FIG. 4B. Void 33 should not be confused with gap 28 of FIG. 3. The significance of void 33 is to create additional volume to hold oil spillage in situations where the diameter of second cylindrical member 22 cannot be made as large as desired due to clearance restrictions. Void 33 has the shape of a hollow cylinder defined as the volume between outer surface 16 of first cylindrical member 12 and inner surface 25 of second cylindrical member 22 immediately adjacent to outer surface 16 of first cylindrical member 12. Void 33, in combination with gap 28, is of sufficient volume to contain the oil spillage associated with the loosening and removal of oil filter 5. The specific volume of void 33 is a design choice governed by how high or low intermediate member 30 is positioned with respect to first cylindrical member 12. A typical value for the volume of inventive void 33, in combination with inventive gap 28, would be within, but not limited to, a range of approximately 5 to 30 percent of the volume of oil filter 5.

It is important to note that the embodiment of FIG. 4B can be described as a cup within a cup. Prior art oil filter socket wrench 10 would inherently define an inner cup. Second cylindrical member 22 with intermediate member 30 and circular base 6 of prior art oil filter socket wrench 10 would inherently define an outer cup. Both cups would share circular base 6.

The oil filter socket wrench 20 of the present invention is quite easy to use and can be used in a couple of ways. One way is to place the device over an oil filter without engaging angled facets 11 to the filter. Second cylindrical member 22 is then squeezed and turned. The frictional grip created between protuberances 38 and the filter will normally loosen the filter. For best results, second cylindrical member 22 should be gripped at points immediately exterior to the protuberances. In the event that the filter is stuck, the device can be used by the second method. Oil filter socket wrench 20 is placed over the oil filter with angled facets 11 of oil filter socket wrench 20 engaged with the corresponding angled facets of the oil filter. A ratchet drive or other drive tool is then used to apply torque to circular base 6 to loosen and remove the oil filter. Either way, when the oil filter is loosened and removed, oil spillage 3 will be contained within the inventive cup 21 of the present invention.

While keeping with the spirit of the present invention, it is anticipated the present invention may be constructed by contemporary manufacturing processes and with a variety of materials. For example, if an entirely rigid structure is desired, the present invention could be made from a steel stamping or could be molded from a high impact plastic. In the alternative, the present invention can be molded from a synthetic rubber to provide a flexible structure. Additionally, in view of conventional vulcanizing processes and composite methods of construction, a portion of the present invention could be made rigid and another portion made flexible. The structure described herein is not limited to particular methods of construction.

What is claimed is:

1. An oil filter socket wrench with built-in oil spillage cup for loosening and removing a spin-on engine oil filter and for containing oil spillage comprising:

a circular base having an upper surface and a lower surface;

a first substantially cylindrical member having an upper portion, a lower portion, an inner surface, and an outer surface;

said upper surface of said circular base affixed to said lower portion of said first substantially cylindrical member;

a second substantially cylindrical member having a substantially larger diameter than said first substantially cylindrical member and having an upper portion, a lower portion, an inner surface, and an outer surface;

an intermediate member securing the upper portion of the outer surface of said first substantially cylindrical member to the lower portion of the inner surface of said second substantially cylindrical member, wherein said first and said second substantially cylindrical members are concentric;

said circular base, said first and said second substantially cylindrical members, and said intermediate member forming a unified integral cup impermeable to engine oil for the purpose of containing oil spillage;

angled facets positioned about the inner surface of the lower portion of said first substantially cylindrical member for the purpose of engaging corresponding angled facets of an oil filter, wherein torque applied to the socket wrench is transmitted to an oil filter for the purpose of loosening and removing an oil filter;

protuberances positioned about the inner surface of said second substantially cylindrical member and extending radially inward to terminate in loose contact with an oil filter positioned within said socket wrench, wherein said protuberances are capable of providing alignment of said socket wrench about an oil filter;

a gap between the inner surface of said second substantially cylindrical member and an oil filter when the socket wrench is positioned about an oil filter, wherein said gap is of sufficient volume to contain oil spillage associated with loosening and removing an oil filter.

2. The device of claim 1, further comprising:

means to attach a drive tool positioned on the lower surface of said circular base for the purpose of applying torque to said socket wrench;

wherein said first substantially cylindrical member and said circular base are constructed of a substantially rigid material capable of withstanding the stress of loosening and removing an oil filter without significant deformation.

3. The device of claim 1, wherein:

said second substantially cylindrical member is constructed of flexible material capable of being deformed when squeezed by hand for the purpose of creating a frictional grip on an oil filter when said second substantially cylindrical member of said device is positioned about an oil filter for the purpose of loosening and removing an oil filter.

4. The device of claim 1, wherein:

said unified integral cup is constructed of substantially rigid material.

5. The device of claim 1, wherein:

said unified integral cup is constructed of substantially flexible material.

6. The device of claim 1, wherein:

said first substantially cylindrical member is constructed of a substantially rigid material; and said second substantially cylindrical member is constructed of a substantially flexible material.

7. The device of claim 1, wherein:

said gap has a volume equal to approximately thirty percent of the volume of an oil filter positioned and aligned within said device.

8. The device of claim 1, further comprising:

a lip affixed to the upper portion of the inner surface of said second substantially cylindrical member and facing inward to reduce spillage if tilted.

9. The device of claim 1, wherein:

a circumference of said second substantially cylindrical member is approximately twenty percent larger than a circumference of said first substantially cylindrical member.

10. The device of claim 1, further comprising:

a bottom portion extending below said lower portion of said second substantially cylindrical member, wherein said bottom portion is capable of supporting said second substantially cylindrical member and said socket wrench in an upright manner when set on a level surface.

11. An oil filter socket wrench with built-in oil spillage cup for loosening and removing a spin-on engine oil filter and for containing oil spillage comprising:

a circular base having an upper surface and a lower surface;

a first substantially cylindrical member having an upper portion, a lower portion, an inner surface, and an outer surface;

said upper surface of said circular base affixed to said lower portion of said first substantially cylindrical member;

a second substantially cylindrical member having a substantially larger diameter and length than said first substantially cylindrical member and having an upper portion, a lower portion, an inner surface, and an outer surface;

an intermediate member securing the lower portion of the outer surface of said first substantially cylindrical member to the lower portion of the inner surface of said second substantially cylindrical member, wherein said first and said second substantially cylindrical members are concentric;

said circular base, said first and said second substantially cylindrical members, and said intermediate member forming a unified integral cup impermeable to engine oil for the purpose of containing oil spillage;

angled facets positioned about the inner surface of the lower portion of said first substantially cylindrical member for the purpose of engaging corresponding angled facets of an oil filter, wherein torque applied to the socket wrench is transmitted to an oil filter for the purpose of loosening and removing an oil filter;

protuberances positioned about the inner surface of said second substantially cylindrical member and extending radially inward to terminate in loose contact with an oil filter positioned within said socket wrench, wherein said protuberances are capable of providing alignment of said socket wrench about an oil filter;

a gap above said first substantially cylindrical member and between the inner surface of said second substantially cylindrical member and an oil filter when the socket wrench is positioned about an oil filter;

a void located above said intermediate member and between said first and said second substantially cylindrical members;

wherein said gap, in combination with said void, is of sufficient volume to contain oil spillage associated with the loosening and removing of an oil filter.

12. The device of claim 11, further comprising:

means to attach a drive tool positioned on the lower surface of said circular base for the purpose of applying torque to said socket wrench;

wherein said first substantially cylindrical member and said circular base are constructed of a substantially rigid material capable of withstanding the stress of loosening and removing an oil filter without significant deformation.

13. The device of claim 11, wherein:

said second substantially cylindrical member is constructed of flexible material capable of being deformed when squeezed by hand for the purpose of creating a frictional grip on an oil filter when said second substantially cylindrical member of said device is positioned about an oil filter for the purpose of loosening and removing an oil filter.

14. The device of claim 11, wherein:

said unified integral cup is constructed of substantially rigid material.

15. The device of claim 11, wherein:

said unified integral cup is constructed of substantially flexible material.

16. The device of claim 11, wherein:

said first substantially cylindrical member is constructed of a substantially rigid material; and said second substantially cylindrical member is constructed of a substantially flexible material.

17. The device of claim 11, wherein:

said gap, in combination with said void, has a volume equal to approximately thirty percent of the volume of an oil filter positioned and aligned within said device.

18. The device of claim 11, further comprising:

a lip affixed to the upper portion of the inner surface of said second substantially cylindrical member and facing inward to reduce spillage if tilted.

19. The device of claim 11, wherein:

a circumference of said second substantially cylindrical member is approximately twenty percent larger than a circumference of said first substantially cylindrical member.

20. The device of claim 11, further comprising:

a bottom portion extending below said lower portion of said second substantially cylindrical member, wherein said bottom portion is capable of supporting said second substantially cylindrical member and said socket wrench in an upright manner when set on a level surface.

21. An oil filter socket wrench with built-in oil spillage cup, comprising:

an oil filter socket wrench including a substantially cylindrical section with an upper portion, lower portion, inner surface, and outer surface;

an oil spillage cup including a substantially cylindrical section with an upper portion, lower portion, inner surface, and outer surface;

an intermediate member connecting said socket wrench to said oil spillage cup;

a lip of annular geometry positioned on the inner surface at the upper portion of the substantially cylindrical section of said oil spillage cup;

protuberances circumferentially positioned on the inner surface of said oil spillage cup below said lip; wherein said socket wrench is concentrically positioned within said oil spillage cup;

said intermediate member connects the outer surface of the upper portion of the substantially cylindrical section of said socket wrench to the inner surface of the lower portion of the substantially cylindrical section of said oil spillage cup;

said socket wrench, said oil spillage cup, and said intermediate member forming a unified integral device impermeable to oil for the purpose of containing oil spillage.

22. The device of claim 21, wherein:

said oil spillage cup is a flexible member and is deformable when squeezed by hand to create a frictional grip between said protuberances and an oil filter when an oil filter is positioned within said oil spillage cup;

said socket wrench is substantially rigid.

23. The device of claim 21, further comprising:

a gap annularly positioned between said oil spillage cup and an oil filter when an oil filter is positioned within said cup; wherein said gap defining a volume to contain oil spillage.

24. The device of claim 21, further comprising:

angled facets circumferentially positioned about the inner surface of the lower portion of said oil filter socket wrench for the purpose of engaging corresponding angled facets of an oil filter.

25. An oil filter socket wrench with built-in oil spillage cup, comprising:

an oil filter socket wrench including a substantially cylindrical section with an upper portion, lower portion, inner surface, and outer surface;

an oil spillage cup including a substantially cylindrical section with an upper portion, lower portion, inner surface, and outer surface;

an intermediate member connecting said socket wrench to said oil spillage cup;

a bottom portion extending below the lower portion of the substantially cylindrical section of said oil spillage cup; wherein said bottom portion is capable of supporting said socket wrench and said oil spillage cup upright when set on a level surface;

said socket wrench is concentrically positioned within said oil spillage cup;

said intermediate member connects the outer surface of the upper portion of the substantially cylindrical section of said socket wrench to the inner surface of the lower portion of the substantially cylindrical section of said oil spillage cup;

said socket wrench, said oil spillage cup, and said intermediate member forming a unified integral device impermeable to oil for the purpose of containing oil spillage.

26. The device of claim 25, further comprising:

angled facets circumferentially positioned about the inner surface of the lower portion of said oil filter socket wrench for the purpose of engaging corresponding angled facets of an oil filter.

27. An oil filter socket wrench with built-in oil spillage cup, comprising:

an oil filter socket wrench including a substantially cylindrical section with an upper portion, lower portion, inner surface, and outer surface;

an oil spillage cup including a substantially cylindrical section with an upper portion, lower portion, inner surface, and outer surface;

an intermediate member connecting said socket wrench to said oil spillage cup;

a lip of annular geometry positioned on the inner surface at the upper portion of the substantially cylindrical section of said oil spillage cup;

protuberances circumferentially positioned on the inner surface of said oil spillage cup below said lip; wherein said socket wrench is concentrically positioned within said oil spillage cup;

said intermediate member connects the outer surface of the lower portion of the substantially cylindrical section of said socket wrench to the inner surface of the lower portion of the substantially cylindrical section of said oil spillage cup;

said socket wrench, said oil spillage cup, and said intermediate member forming a unified integral device impermeable to oil for the purpose of containing oil spillage.

28. The device of claim 27, wherein:

said oil spillage cup is a flexible member and is deformable when squeezed by hand to create a frictional grip between said protuberances and an oil filter when an oil filter is positioned within said oil spillage cup;

said socket wrench is substantially rigid.

29. The device of claim 27, further comprising:

a gap annularly positioned between said oil spillage cup and an oil filter when an oil filter is positioned within said cup; wherein said gap defining a volume to contain oil spillage.

30. The device of claim 29, further comprising:

a void located above said intermediate member and between said first and said second substantially cylindrical members; wherein said void, in combination with said gap, define a volume to contain oil spillage.

31. The device of claim 27, further comprising:

angled facets circumferentially positioned about the inner surface of the lower portion of said oil filter socket wrench for the purpose of engaging corresponding angled facets of an oil filter.

32. An oil filter socket wrench with built-in oil spillage cup, comprising:

an oil filter socket wrench including a substantially cylindrical section with an upper portion, lower portion, inner surface, and outer surface;

an oil spillage cup including a substantially cylindrical section with an upper portion, lower portion, inner surface, and outer surface;

an intermediate member connecting said socket wrench to said oil spillage cup;

a bottom portion extending below the lower portion of the substantially cylindrical section of said oil spillage cup; wherein said bottom portion is capable of supporting said socket wrench and said oil spillage cup upright when set on a level surface;

said socket wrench is concentrically positioned within said oil spillage cup;

said intermediate member connects the outer surface of the lower portion of the substantially cylindrical section of said socket wrench to the inner surface of the lower portion of the substantially cylindrical section of said oil spillage cup;

said socket wrench, said oil spillage cup, and said intermediate member forming a unified integral device impermeable to oil for the purpose of containing oil spillage.

33. The device of claim 32, further comprising:

angled facets circumferentially positioned about the inner surface of the lower portion of said oil filter socket wrench for the purpose of engaging corresponding angled facets of an oil filter.

34. An entirely flexible oil spillage collecting device, comprising:

a cup shaped member with a bottom portion and a cylindrical body portion;

said cup shaped member formed to matingly engage angled facets located at an oil filter bottom;

an upper cylindrical member concentrically positioned around the cylindrical body portion of said cup shaped member;

a gap having a volume to contain oil spillage is present between said upper cylindrical member and an oil filter when an oil filter is positioned within said device;

protuberances circumferentially positioned on an inner surface of said upper cylindrical member capable of providing a frictional grip on an oil filter when an oil filter is positioned within said device;

a lip of annular geometry positioned on said upper cylindrical member above said protuberances.

35. The device of claim 34, wherein:

said device is molded from a synthetic rubber.

36. The device of claim 34, wherein:

said device is deformable when squeezed by hand to create a frictional grip between said device and an oil filter when an oil filter is positioned within said device.

* * * * *

UNITED STATES PATENT AND TRADEMARK OFFICE

CERTIFICATE OF CORRECTION

PATENT NO. : 6,227,078 B1
DATED : May 8, 2001
INVENTOR(S) : Vincent John Lemmo, Jr.

It is certified that error appears in the above-identified patent and that said Letters Patent is hereby corrected as shown below:

Abstract,
Line 11, delete "constricted", and insert instead -- constructed --.

Column 4,
Line 26, delete "chalking", and insert instead -- caulking --.

Column 4,
Line 27, delete "chalk", and insert instead -- caulk --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*